United States Patent [19]

Piesen et al.

[11] Patent Number: 4,485,612

[45] Date of Patent: Dec. 4, 1984

[54] APPARATUS FOR MANIPULATING ROLLS OF CONVOLUTED PAPER OR THE LIKE

[75] Inventors: Stephan Piesen; Joze Zajec, both of Krefeld, Fed. Rep. of Germany

[73] Assignee: Kleinewefers GmbH, Krefeld, Fed. Rep. of Germany

[21] Appl. No.: 333,560

[22] Filed: Dec. 22, 1981

[30] Foreign Application Priority Data

Dec. 24, 1980 [DE] Fed. Rep. of Germany ..... 3049096

[51] Int. Cl.[3] ..... B65B 57/14

[52] U.S. Cl. ..... 53/504; 53/211; 53/214; 53/216; 53/389

[58] Field of Search ..... 53/216, 214, 211, 204, 53/504, 503, 52, 389

[56] References Cited

U.S. PATENT DOCUMENTS

| | | | |
|---|---|---|---|
| 2,578,297 | 12/1951 | Gerlach | 53/216 X |
| 3,290,861 | 12/1966 | Prager | 53/214 |
| 3,407,565 | 10/1968 | Bender et al. | 53/214 |
| 3,715,861 | 2/1973 | Odelberg | 53/211 |
| 3,716,964 | 2/1973 | Reynolds et al. | 53/211 X |
| 3,924,375 | 12/1975 | Brenner et al. | 53/211 X |
| 3,968,622 | 7/1976 | Kataoka | 53/504 |

FOREIGN PATENT DOCUMENTS

| | | | |
|---|---|---|---|
| 608707 | 5/1978 | U.S.S.R. | 53/504 |

*Primary Examiner*—James F. Coan

*Attorney, Agent, or Firm*—Peter K. Kontler

[57] ABSTRACT

Apparatus for providing cylindrical paper rolls with envelopes consisting of inner discs which are adjacent to the end faces of the rolls, of blanks which are draped around the peripheries of the rolls and whose marginal portions are folded over the inner discs, and of outer discs which are pasted over the folded marginal portions of the blanks has a feeding unit which delivers successive rolls axially to a monitoring station where the dimensions of the rolls are ascertained by sensors and where the recesses in the end faces of the rolls receive expandible clamping heads of a lifting device serving to advance the rolls, in horizontal positions, past a draping and thereupon past a blank-folding station. The heads are movable toward each other in response to signals from the sensors to enter the recesses of a roll at the monitoring station, and such heads deliver successive rolls to an intermediate conveyor which, in turn, delivers successive rolls to an orientation changing device. The latter turns each roll through 90° so that the axes of the rolls are vertical prior to deposition on the roll of a removing conveyor.

36 Claims, 9 Drawing Figures

Fig.5
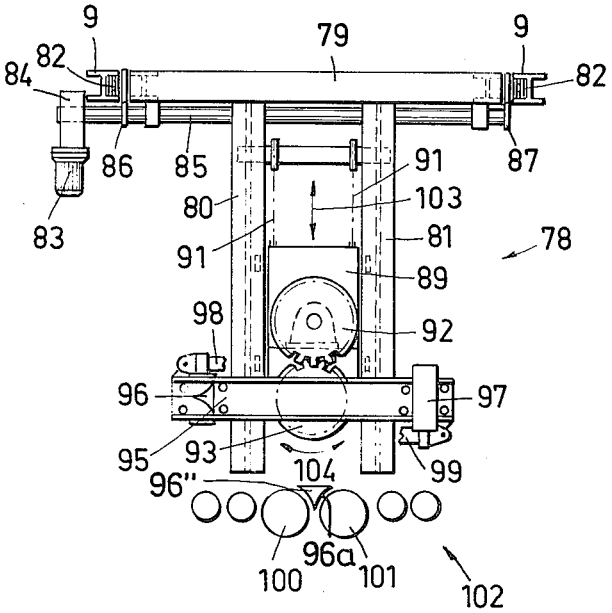
Fig.6
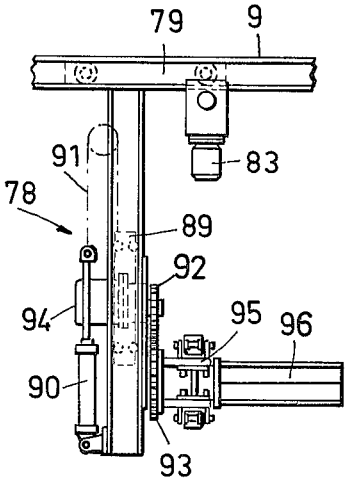
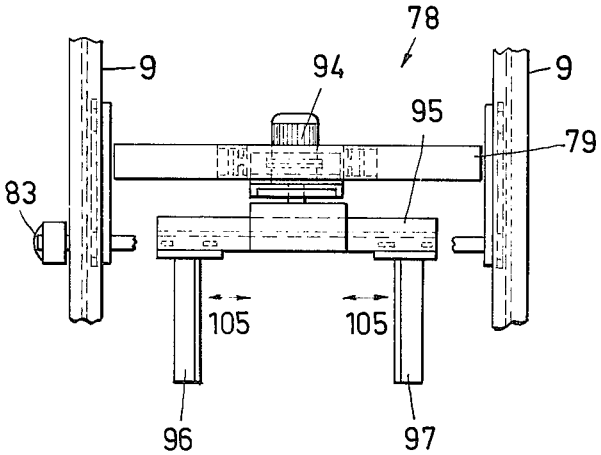
Fig.7

APPARATUS FOR MANIPULATING ROLLS OF CONVOLUTED PAPER OR THE LIKE

BACKGROUND OF THE INVENTION

The present invention relates to apparatus for processing rolls of convoluted paper or other flexible sheet material. More particularly, the invention relates to improvements in apparatus wherein the processing of relatively large paper rolls or the like (hereinafter called rolls for short with the understanding that this term is intended to embrace rolls of any desired diameter and/or axial length as well as rolls which consist of paper, metallic or plastic foil, cardboard and/or any other sheet material which can be convoluted onto a core to form a cylindrical body) involves, among others, the draping of each roll into a blank of suitable wrapping material. Still more particularly, the invention relates to improvements in apparatus for treating rolls with centrally located recesses in one or both end faces thereof (such recesses can form part of an uninterrupted axial hole in the roll, or an uninterrupted hole or bore in an elongated tubular core around which the windings of the roll are convoluted and which may but need not be removable or withdrawable from the innermost convolution of the coiled flexible sheet material, or which can constitute sockets in cylindrical or similar plugs recessed into the respective end faces of the roll).

The assignee of the present application manufactures and offers for sale a processing machine (known as Kleinewefers Rollenpackmaschine Typ 6.6) wherein a discrete disc-shaped inner cover (hereinafter called inner disc) is placed adjacent to each end face of each of a series of successive rolls while the axes of the rolls are maintained in horizontal or nearly horizontal positions. Successive rolls are thereupon rotated about their axes during application of blanks of wrapping material (e.g., lightweight cardboard) to their peripheral surfaces in such a way that the marginal portions of each blank extend beyond the respective end faces of the corresponding roll. In the next step, the thus coarsely draped roll is introduced into a folding unit which folds the projecting marginal portions of the respective blank over the adjacent end faces of the roll before the roll is introduced into the space between two pressure-applying plates serving to apply disc-shaped outer covers (hereinafter called outer discs) over the respective folded-over marginal portions to thereby complete the confinement of each roll in a hollow cylindrical envelope having a cylindrical shell surrounding the outermost convolution of the respective roll and two composite end walls each including an inner disc and an outer disc as well as the suitably deformed or folded corresponding marginal portion of the blank therebetween. The just discussed apparatus of the assignee further comprises suitable units which deliver the rolls to various stations, which remove finished products (wrapped rolls) from the last station, and which transport the rolls (with or without portions of their envelopes) between successive stations. Still further, the just discussed apparatus comprises various sensors, means for applying adhesive to selected portions of the discs and/or blanks, and/or other components which allow for semiautomatic or fully automatic processing of rolls on the way to storage or to another destination, e.g., to conveyances which transport finished products to customers.

The means for delivering successive rolls of a short or long series of rolls to the first station of the aforediscussed apparatus of the assignee of the present invention comprises a conveyor system which moves successive rolls axially so that a portion of the peripheral surface of each roll rests on a mobile support in the form of a belt conveyor. A pusher or another suitable ejecting device is provided to transfer the rolls from the belt conveyor onto an inclined surface along which successive rolls roll by gravity and where the progress of the rolls is controlled by suitable regulating elements in the form of mobile stops or the like so that each roll advances into the range of a centering device. The centering device is disposed at the lower end of the inclined surface and includes two centering plates arranged to engage the end faces of an oncoming roll for the purpose of ensuring that such roll is halved by the imaginary central symmetry plane of the draping unit which is located immediately behind the centering device. The draping unit employs two driven rollers on which the freshly supplied and centered roll rests in horizontal position and which cause such roll to rotate about its own axis. The draping unit further comprises several sources of wrapping material (each such source includes a supply of convoluted draping material having a predetermined width and means for selecting that source which is best suited for adequate draping of the roll at the draping station (i.e., for selecting a source which supplies wrapping material in the form of a web having a width exceeding the axial length of the roll at the draping station by a preselected value to thus ensure that each marginal portion will project beyond the respective end face of the roll to an extent which is needed for the making of a sufficiently strong hollow cylindrical envelope without excessive waste in wrapping material). The selected web of wrapping material is caused to run along a paster containing a supply of suitable adhesive paste, and the web is thereupon advanced between the aforementioned driven rollers and the roll at the draping station. Pivotable or otherwise movable belts, bands or analogous guide elements are provided to properly guide the web of selected wrapping material at the draping station. The roll is thereupon transferred to the folding station which follows the draping station and where blades, wheels or otherwise configurated folding elements are employed to fold the marginal portions of the freshly convoluted blank over the respective end faces of the roll. During such treatment at the folding station, the roll again rests (in horizontal position) on two driven rollers which cause the roll to rotate about its own axis. When the folding operation is completed, the roll is caused to advance to the aforementioned pressure-applying station, namely, to the station where the folded-over marginal portions of a blank are concealed by outer discs. The thus finished roll thereupon advances onto a weighing device and to a belt conveyor which travels in a direction at right angles to the path of movement of the oncoming roll. A shock absorber is provided to arrest a finished product in the region of the belt conveyor which then advances the product by moving it axially while a portion of the cylindrical envelope rests on the upper reach of the conveyor.

The operation of the just discussed apparatus can be automated to a desired extent. This necessitates the provision of sensor means which ascertain the diameter and the axial length of each oncoming roll and generate appropriate signals which are used to select the width of wrapping material, the extent of axial and/or other displacement of the rolls, the extent of angular movement of rolls about their respective axes at the draping and/or other stations, and so forth. The operation of the aforediscussed known apparatus is highly satisfactory and, therefore, the apparatus has found widespread acceptance in the paper making, textile and many other industries. It has been found that such apparatus is especially suitable for rapid, economical and predictable processing of large and hence very heavy and bulky paper rolls. However, certain types of paper or other material of which the rolls consist necessitate an extremely careful and gentle treatment. For example, pressure-sensitive papers, such as carbon papers of the type known as or resembling so-called NCR papers, must be treated with utmost care in order to prevent undesirable defacing or marking of convolutions during treatment in the making plant. The same applies for many types of rolls consisting of very soft paper or of paper which is coiled or wound in the form of loose convolutions that should remain intact during wrapping, shipment and/or storage. The just discussed highly sensitive papers must be held out of contact with plungers or analogous ejectors, roller-shaped or otherwise configurated stops, shock absorbers and/or driver rollers which engage the periphery of a relatively large roll. Moreover, the folding, draping and/or certain other instrumentalities of apparatus for the treatment of such highly sensitive web or strip stock must be designed with a view to avoid the application of pronounced pressure to any part of a roll, i.e., to the convolutions which are confined when the roll is fully wound as well as to the outermost convolution of each roll.

OBJECTS AND SUMMARY OF THE INVENTION

An object of the invention is to provide a novel and improved apparatus which can treat sturdy (especially pressure-resistant) as well as highly sensitive rolls with the same degree of accuracy, reliability and reproducibility.

Another object of the invention is to provide the apparatus with novel and improved means for preventing the application of excessive pressure to any part of a roll during delivery to the first treating station, during treatment at any of several stations, during transfer from station to station and/or during removal from the apparatus.

A further object of the invention is to provide the apparatus with novel and improved means for transferring successive rolls from a first conveyor system whereon the rolls advance axially onto a second conveyor system which moves the rolls sideways (i.e., at right angles to the axes of the rolls) or vice versa.

An additional object of the invention is to provide the apparatus with novel and improved conveyor means for axial, sidewise and/or other transport of rolls toward, between and beyond various processing stations.

Another object of the invention is to provide the apparatus with novel and improved means for preventing any contact between the pressure-sensitive material of a roll and the various instrumentalities during transfer of oncoming rolls to the draping station.

Another object of the invention is to provide the apparatus with novel and improved means for changing the orientation of successive rolls, especially for changing the inclination of the axis of each roll from horizontal to vertical or vice versa.

A further object of the invention is to provide the apparatus with novel and improved means for taking greater advantage of the presence and characteristics of the core which is surrounded by the innermost convolution of the convoluted material.

An additional object of the invention is to provide the apparatus with novel and improved conveyor means which can transport the rolls toward, past and beyond two or more successive stations.

The invention resides in the provision of an apparatus which serves to provide a series of at least substantially cylindrical rolls consisting of convoluted paper, foil, cardboard or the like and having coaxial recesses provided in the end faces thereof with inner discs which are placed adjacent to the end faces of the rolls, with blanks whose width exceeds the axial length of the rolls so that the marginal portions of the blanks extend beyond and can be folded over the respective inner discs, and with outer discs which are applied over the folded-over marginal portions of the blanks. The apparatus comprises a feeding unit having means (e.g., discrete carriages) for supplying successive rolls of the aforementioned series to a predetermined location (e.g., to a roll monitoring station) where the axes of the rolls are at least substantially horizontal, a conveyor which is spaced apart from the feeding unit (i.e., from the predetermined location), and a lifting device which serves to transfer successive rolls of the series along a predetermined path (such path can be defined by a pair of overhead guide rails) from the predetermined location onto the conveyor. The lifting device comprises a pair of spaced-apart coaxial clamping means, means for moving the clamping means along the predetermined path, means for moving the clamping means toward and away from each other so that the clamping means can be introduced into the recesses of a roll at the predetermined location prior to transport of the clamping means toward the conveyor and withdrawn from the recesses upon deposition of the roll on the conveyor, and means for rotating a roll between the clamping means about the axis of such roll through the medium of at least one of the clamping means.

The means for moving the clamping means toward and away from each other preferably comprises a pair of spaced-apart sections (which can constitute component parts of a skeleton frame of the lifting device), one for each of the clamping means, a distancing element interposed between each of the sections and the respective clamping means to allow for the draping of rolls into blanks whose width exceeds the axial length of the rolls, and motor means for moving the sections toward and away from each other.

The apparatus preferably further comprises means for draping blanks about successive rolls in a predetermined portion of the path (preferably at a draping station which can be placed close to the aforementioned conveyor) and means for thereupon folding the marginal portions of the thus draped blanks along the respective inner discs which are adjacent to the end faces of the rolls. As a rule, each roll will have a coaxial hollow core defining a hole or bore which includes the recesses of the respective roll, and the clamping means preferably include heads (such as live lathe centers) with fingers, claws or otherwise configurated portions movable outwardly into engagement with the surface bounding the hole of a core.

The lifting device preferably further comprises means for moving the clamping means up and down with reference to the predetermined path so that the clamping means can lift successive rolls off the feeding unit at the predetermined location and deposit successive rolls on the conveyor.

The supplying means preferably comprises cushions for the rolls on the feeding unit, and the conveyor preferably comprises cushion means for deposition of rolls thereon. Such features are especially desirable when the rolls consist of a material which is highly or extremely sensitive to pressure.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 5 is an enlarged front elevational view of an orientation changing device in the apparatus of FIG. 1;

FIG. 6 is a side elevational view of the orientation changing device shown in FIG. 5;

FIG. 7 is a plan view of the orientation changing device shown in FIGS. 5 and 6;

DESCRIPTION OF THE PREFERRED EMBODIMENTS

Figure 1:
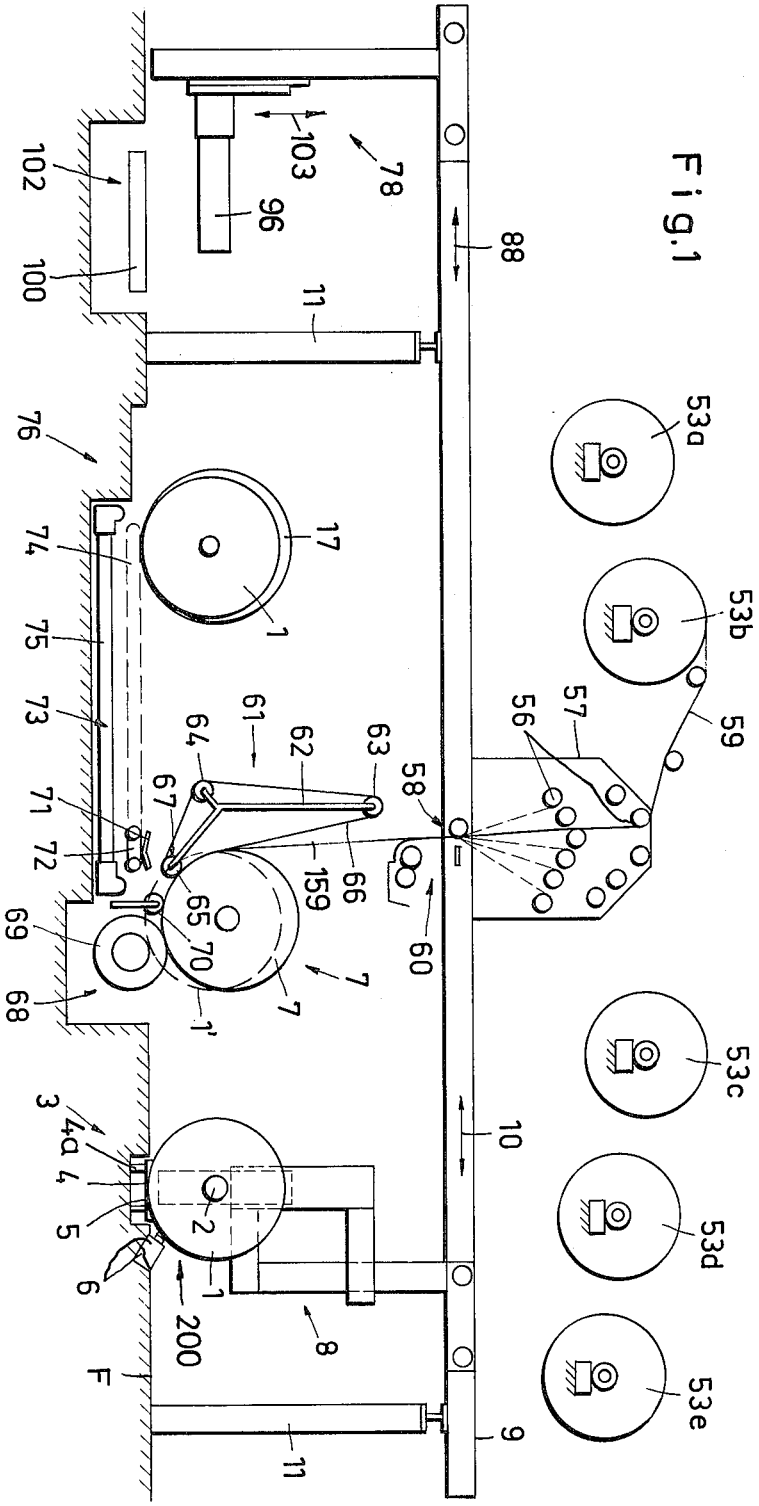
FIG. 1 is a schematic elevational view of an apparatus which embodies one form of the invention.

The apparatus which is shown in FIG. 1 serves to treat rolls 1 each of which is assumed to consist (a) of a length of convoluted paper web or tape and (b) of a core 2 having an axial bore or passage which is open at both ends. The apparatus comprises a roll feeding or supplying unit 3 having a conveyor here shown as including a series of roll-supplying carriages 4 or analogous transporting elements (only one shown) which are recessed into the foundation or floor F of the plant wherein the apparatus is used and are movable along rails 4*a* in a direction at right angles to the plane of FIG. 1, i.e., in a direction which is parallel to the axes of the rolls 1 on successive carriages 4. Each of the carriages 4 is preferably provided with a soft top wall or cushion 5 (such cushion may be made of foam rubber or another elastomeric synthetic plastic material) defining a horizontal receiving flute in which a portion of the peripheral surface of the respective roll 1 rests during transport to a monitoring station 200 where the dimensions of each roll 1 are ascertained by several sensors or detectors including a battery of photocells 6 or analogous signal generating means. The distribution of sensors 6 (only two can be seen in FIG. 1) is preferably such that the signals which are transmitted thereby on arrival of a fresh roll 1 at the monitoring station 200 are indicative of the diameter and also of the axial length of the respective roll. Signals from one or more sensors 6 control the drive means (not specifically shown) for the carriages 4 in such a way that the foremost roll 1 comes to rest in a position in which it is halved by an imaginary vertical symmetry plane 25 (FIG. 2) extending at right angles to the axis of the respective core 2. The just mentioned symmetry plane 25 is the symmetry plane of the arrangement at a draping or wrapping station 7 which follows the monitoring station 200, as considered in the direction of transport of successive rolls 1 through the improved apparatus.

The feature that the extent of movement of the carriages 4 in a direction at right angles to the plane of FIG. 1 is controlled by the sensors 6 (i.e., that the sensors 6 constitute arresting means for the carriages 4) is advantageous because there is no need to shift the rolls 1 relative to their carriages 4 in order to place such rolls in optimum positions with reference to the symmetry plane 25. This is desirable on the ground that the outermost convolutions of the rolls 1 are not likely to be damaged during centering and also because the centering is effected automatically as an adjunct to movement of the carriages 4 to positions in which the rolls 1 thereon can be taken over by the next unit of the apparatus, namely, by a lifting device 8.

Figure 4:
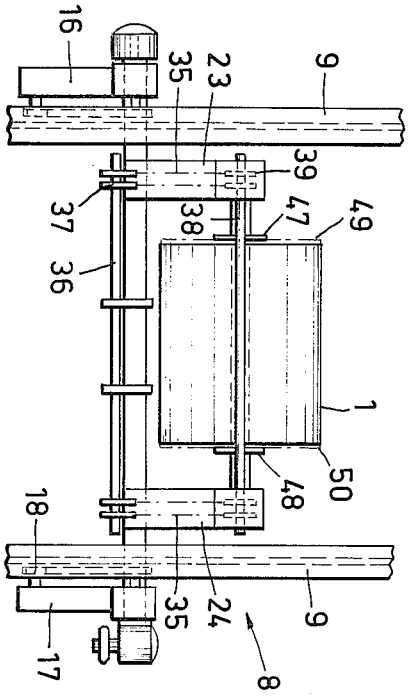
FIG. 4 is a plan view of the lifting device shown in FIGS. 2 and 3.
Figure 2:
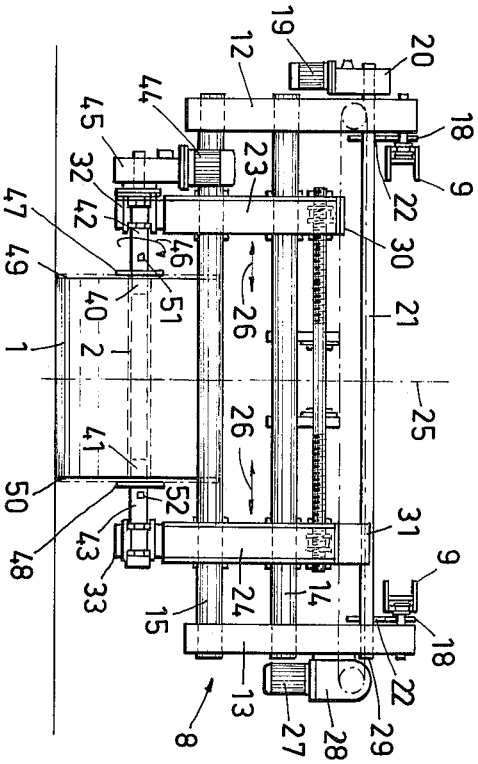
FIG. 2 is an enlarged front elevational view of a lifting device which is employed in the apparatus of FIG. 1.
Figure 3:
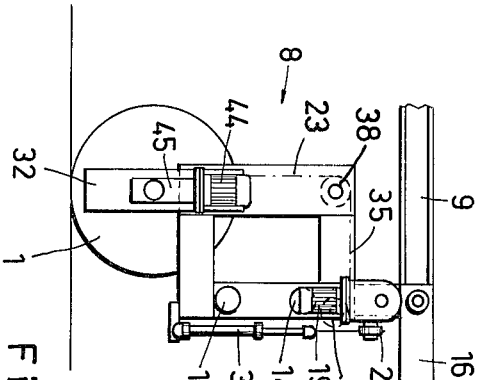
FIG. 3 is a side elevational view of the lifting device shown in FIG. 2.

The lifting device or elevator 8 is movable to the monitoring station 200 to lift successive rolls 1 off their carriages 4 and to transfer such rolls into the range of instrumentalities at the aforementioned draping or wrapping station 7. The details of the lifting device 8 are shown in FIGS. 2, 3 and 4. This device is reciprocable back and forth (note the double-headed arrow 10 in FIG. 1) along several parallel horizontal overhead rails 9 which are mounted at the upper ends of upright columns or posts 11 resting on or embedded in the floor F or in a base frame (not specifically shown) of the plant wherein the apparatus of the present invention is put to use (such plant is assumed to be a paper processing plant). The illustrated rails 9 are horizontal I-beams and are disposed at a level above a skeleton frame of the lifting device 8. Such skeleton frame comprises two spaced-apart upright frame members 12 and 13 and several horizontal traverses or crossheads 14, 15 which extend between and whose end portions are welded or otherwise permanently or removably secured to the respective upright frame members 12 and 13. The upper end portions of the frame members 12 and 13 are respectively provided with horizontal arms 16 and 17 having rollers or wheels 18 which extend into the spaces between the upper and lower horizontal flanges of the respective rails 9 at the outer sides of the corresponding vertical webs of such rails. The wheels 18 can be driven by a reversible electric motor 19 whose output element transmits torque to the input element of a transmission 20 serving to rotate a horizontal shaft 21 extending transversely of the path of reciprocatory movement of the lifting device 8 along the rails 9. The shaft 21 carries two gears 22 which transmit torque to the respective wheels 18 in order to advance the lifting device 8 from the monitoring station 200 to the draping station 7 or vice versa.

The skeleton frame of the lifting device 8 further comprises two frame elements 23 and 24 which are reciprocable along the crossheads 14 and 15 (or at least along one of these crossheads) toward and away from each other (note the double-headed arrows 26 in FIG. 2), i.e., at right angles to the longitudinal direction of the rails 9. The drive means for moving the frame elements 23 and 24 with reference to each other is designed in such a way that the extent to which the frame element 23 moves toward or away from the aforementioned central vertical symmetry plane 25 is the same as the extent to which the other frame element 24 moves toward or away from the plane 25. In other words, the frame elements 23, 24 are always compelled to move in opposite directions but to the same extent. The drive means for moving the frame elements 23 and 24 along the crossheads 14 and 15 comprises a reversible electric motor 27 whose output element drives the input element of a transmission 28. The transmission 28 drives an endless chain 29 which is disposed in a plane extending at right angles to the longitudinal direction of the rails 9. The horizontal upper reach of the chain 29 (this chain can be replaced by an endless belt or another suitable endless flexible element) is connected with the frame element 24 by a first coupling member 31, and the horizontal lower reach of the chain 29 is connected with the frame element 23 by a second coupling member 30.

The lifting device 8 still further comprises two lateral portions or sections 32 and 33 which are movable up and down in the respective frame elements 23 and 24, i.e., the sections 32 and 33 are movable between a plurality of different levels. The means 34 for moving the sections 32 and 33 up and down (lengthwise of the respective frame elements 23 and 24) comprises fluid-operated motors in the form of cylinder-and-piston units which are coupled to the respective sections 32 and 33 by means for chains 35 or other suitable flexible elements. The chains 35 are trained over a first set of sprocket wheels 37 on a first horizontal shaft 36 and over a second set of sprocket wheels 39 on a second horizontal shaft 38.

The sections 32 and 33 respectively carry horizontal distancing elements 42 and 43 for two clamping means or heads 40, 41, respectively. The clamping heads 40 and 41 have radially outwardly movable fingers, claws or other suitable engaging elements which can engage the internal surface of a core 2 between the distancing elements 42 and 43 so that the respective roll 1 is then suspended on the sections 32, 33 and can be rotated about its axis in response to rotation of the head 40 and/or 41. The lifting device 8 can be provided with manually operable means (such as rotary cranks) for expelling the respective fingers from the heads 40 and 41 preparatory to lifting of the sections 32, 33 to thereby raise a roll 1 from the cushion 5 of the respective carriage 4 to a level above the monitoring station 200, i.e., to a position in which the roll 1 is supported exclusively by the heads 40, 41 so that its external surface is not contacted by any parts.

At least one of the heads 40 and 41 (in the illustrated embodiment the head 40) is rotatable about its own axis (i.e., about an axis which is common to the heads 40, 41 and distancing elements 42, 43) by a drive including an electric motor 44 and a transmission 45 so as to rotate the suspended roll 1 in the direction indicated by an arrow 46 (see FIG. 2). The heads 40, 41 are rotatable relative to but cannot move axially with reference to the respective sections 32, 33 which, together with the motor 27 and parts 23–24 and 28–31, constitute a means for shifting the heads 40, 41 toward and away from each other.

The clamping heads 40 and 41 respectively carry perforated hollow wheel-shaped disc carriers or flanges 47 and 48 and suitable suction generating means which cause the flanges 47 and 48 to attract two manually or automatically applied inner discs 49 and 50 (indicated in FIGS. 2 and 3 by phantom lines) so that such discs can be placed against the end faces of the roll 1 which is suspended on the heads 40 and 41.

The heads 40 and 41 are preferably hollow and are inwardly adjacent to the elements 51 and 52 which are mounted on the respective distancing elements 42 and 43 (see FIG. 2) and form part of a signal generating device or sensor. For example, the element 51 may constitute the light source and the element 52 can constitute the photosensitive transducer or a photocell. The positioning of the element 51 is preferably such that it transmits a light beam through the hollow heads 40, 41 and through the core 2 between such heads. One of the flanges 47, 48 may constitute the contact of a signal generating switch which controls the extent of movement of the frame elements 23, 24 toward each other and arrests the motor 27 when the discs 49, 50 on the flanges 47, 48 have moved into actual contact with the respective end faces of a roll 1 which is suspended on the heads 40 and 41.

Each of the heads 40, 41 can resemble or constitute a center, such as a live lathe center, with one but preferably two or more radially outwardly movable fingers or claws which can be retracted into the body of the center prior to introduction of the heads 40, 41 into the respective end portions of the hole in a core 2 and which are thereupon moved radially outwardly to engage the internal surface of such core 2 with a force sufficing to ensure that the heads will remain in the core and that the core will be rotated when the head 40 is set in rotary motion.

When the sensors 6 arrest the foremost carriage 4 of the feeding unit 3 in such position that the roll 1 on the foremost carriage 4 is halved by the symmetry plane 25, the sensors 6 maintain the heads 40, 41 of the lifting device 8 at such a distance from each other that the heads are adjacent to but spaced apart from the respective end faces of the roll 1 at the monitoring station 200. At such time, the lifting device 8 can be in the process of moving from the draping station 7 toward the monitoring station 200, i.e., toward the position which is shown in FIG. 1. The sensors 6 transmit signals to the motor 27 which moves the frame elements 23 and 24 away from each other (i.e., away from the respective sides of the symmetry plane 25) to an extent which suffices to allow for unimpeded transport of the lifting device 8 to the position of FIG. 1 in which the heads 40 and 41 flank the core 2 of the roll 1 on the foremost occupied carriage 4 of the feeding unit 3.

As mentioned above, the sensors 6 can also serve to ascertain the diameters of successive rolls 1, and the corresponding signals are used to move the heads 40 and 41 to an appropriate level by way of the motors of the means 34 which can move the sections 32, 33 and hence the heads 40 and 41 up and down. The arrangement is such that the heads 40 and 41 are automatically aligned with the respective ends of the core 2 at the monitoring station 200 before the heads 40 and 41 are caused to move toward each other, i.e., before the heads are caused to penetrate into the respective end portions of the core 2 preparatory to movement of their fingers into requisite frictional or other positive engagement with the internal surface of the core so that the entire roll 1 will be rotated in response to rotation of the head 40 by the motor 44. The exact level of the heads 40 and 41 can also be ascertained by the photocell including the aforediscussed elements 51 and 52 on the respective distancing elements 42 and 43. The light beam which is emitted by the element 51 can reach the element 52 only when the heads 40 and 41 are in accurate alignment with the respective axial ends of the core 2 forming part of the roll 1 at the monitoring station 200.

The inner discs 49 and 50 are caused to adhere to the inner sides of the respective carriers or flanges 47 and 48 before the motor 27 is caused to move the heads 40 and 41 toward each other, i.e., before the heads begin to enter the respective axial ends of the core 2 therebetween. The movements of the heads 40 and 41 toward each other can be terminated in response to signals which are furnished by the sensors 6 (these sensors ascertain the axial length of a roll 1 at the monitoring station 200) or by one of the flanges 47, 48 which, as explained above, can form part of a switch serving as a means for arresting the motor 27 after the inner discs 49 and 50 come into requisite contact with the respective end faces of a roll 1 between the heads 40 and 41.

In the next step, the fingers of the heads 40, 41 are expelled so that they engage the internal surface of the core 2 before the moving means 34 is actuated to raise the heads 40, 41 with a roll 1 therebetween. The motor 19 is thereupon actuated to set the wheels 18 in motion in a direction to advance the lifting device 8 from the monitoring station 200 (the roll 1 between the heads 40 and 41 is already held at a level above the feeding unit 3 including the carriages 4) toward the draping station 7. The motor 44 is started, e.g., in automatic response to arrival of the lifting device 8 at the draping station 7, so that the roll 1 between the distancing elements 42 and 43 rotates about its axis, i.e., about an axis which is common to the heads 40, 41, distancing elements 42, 43 and core 2.

The provision of means 34 (or analogous means) for moving the heads 40 and 41 to different levels is desirable and advantageous because this enables the attendants or an automatic programming unit to move the heads into register with the respective end portions of the cores 2 in larger- or smaller-diameter rolls. As mentioned above, such adjustment of the heads 40 and 41 is preferably initiated by the sensors 6 which ascertain the diameter of an oncoming roll 1 and transmit appropriate signals to actuate the moving means 34 in a sense to raise or lower the heads 40 and 41 to the exact level of the core 2 in the roll 1 on the foremost carriage 4. The photocell including the elements 51 and 52 preferably constitutes or may constitute a safety device which is used to check the operation of the sensors 6, i.e., to ascertain whether or not the signals which are generated by the sensors 6 cause the heads 40 and 41 to move to the exact level of a core 2 in the roll 1 on the foremost carriage 4.

The manner in which the application of suction to the outer sides of inner discs 49, 50 is terminated after folding of the marginal portions of a blank over the outer parts of such discs is not specifically shown in the drawing; it suffices to say that suction in the chambers of the flanges 47 and 48 is caused to collapse as soon as the inner discs are properly held against the respective end faces of the roll 1 even if the flanges 47 and 48 are moved away from each other, i.e., to the left and to the right, as viewed in FIG. 2. Each of the inner discs 49, 50 has a central opening which is smaller than the outer diameter of the respective flange 47, 48 but not smaller than the inner diameter of the core 2 so that the inner discs 49 and 50 cannot interfere with introduction of heads 40 and 41 into the respective ends of a core.

Since a roll 1 is centered not later than when the corresponding carriage 4 comes to a halt, the heads 40 and 41 automatically enter the corresponding end portions of the core 2 in optimum positions for engagement with the internal surface of the core when the sections 32 and 33 of the lifting device 8 are caused to move toward each other under the action of the motor 27 and endless flexible element 29. In other words, the extent to which one of the heads 40, 41 penetrates into the respective end portion of the core 2 is the same as the extent to which the other head penetrates into the adjacent end portion of the same core. The extent of movement of heads 40, 41 in the axial direction of a core 2 therebetween can be readily selected in such a way that a single set of distancing elements 42, 43 suffices for the treatment of each of a large variety of differently dimensioned rolls, i.e., of relatively short or relatively long rolls as well as of rolls which are to be draped into different types of blanks, i.e., into blanks whose marginal portions extend to a greater or lesser extent beyond the one and/or other end face of the roll 1 at the wrapping station 7.

The extent of movement of heads 40 and 41 toward each other can be determined in advance (e.g., when the apparatus is to treat a long series of identical rolls 1), by the sensors 6 at the monitoring station 200, and/or by sensor means on the lifting device 8. Thus, if the dimensions of each of a long series of rolls 1 are the same, the controls for the motor 27 can be adjusted in such a way that this motor automatically arrests the heads 40 and 41 at a predetermined distance from each other, namely, when such heads extend into the respective end portions of the core 2 in a roll 1 at the monitoring station 200. In lieu of such automatic stoppage of the motor 27, the latter can be arrested in response to signals which are generated by the sensors 6 and denote the axial length of the roll 1 between the heads 40 and 41. Still further, the lifting device 8 can carry one or more sensors which respond to movement of the heads 40 and 41 toward each other and arrest the motor 27 at an opportune time, namely, when the two heads 40, 41 extend into the respective end portions of the core 2. The just mentioned sensors may include proximity switches which are mounted on the heads 40, 41 on the distancing elements 42, 43 and/or on other component parts of the lifting device 8 and are capable of generating signals at appropriate times, namely, when the heads 40 and 41 are sufficiently close to each other to ensure adequate engagement of their radially movable clamping fingers with the internal surface of the core 2 in a roll 1 therebetween.

The spacing between the monitoring station 200 and the draping station 7 of FIG. 1 is preferably selected in such a way that a roll 1 which is located at the station 7 does not interfere with the delivery of a fresh roll into the monitoring station 200. This ensures that a fresh roll can be properly located with reference to the symmetry plane 25 even before the lifting device 8 begins to move back toward the monitoring station 200. It will be noted that a roll 1 which is suspended on the heads 40 and 41 of the lifting device 8 moves sideways (i.e., at right angles to the axis of its core 2) during transfer from the monitoring station 200 to the draping station 7. On the other hand, the monitoring and draping stations should be placed as close to each other as possible in order to reduce the length of intervals of travel of empty lifting device 8 from the draping station 7 back to the monitoring station 200.

The space above the draping station 7 accommodates several sources of wrapping material here shown as bobbins or reels 53*a*, 53*b*, 53*c*, 53*d* and 53*e* each of which contains a different supply of paper, cardboard or other suitable wrapping material which is to form the major part of the envelope for a fully confined or wrapped roll 1. The axial length of each of the reels 53*a*–53*e* is preferably different, i.e., the attendant or an automatic selector can choose between wrapping materials having five different widths to thus ensure that the marginal portions of the selected wrapping material extend to a requisite extent beyond the axial ends of a roll 1 at the draping station 7. The web 59 from a selected reel (53*b* in FIG. 1) is transported toward the roll 1 at the draping station 7 by a set of two advancing rolls 56 which are installed in a suitable advancing mechanism 57 of known design. The advancing mechanism 57 is adjacent to a severing device 58 which severs the web 59 so as to form a discrete blank 159 of requisite length, i.e., of a length which suffices to ensure that the blank 159 can be readily draped all around the circumference of the roll 1 at the station 7 with a required degree of overlap between the leader and trailing edge of the blank. The mechanism 57 can comprise a discrete set of two advancing rolls 56 for each of the five reels 53*a* to 53*e*.

The path of a blank 159 extends along a suitable paster 60 which provides selected portions of or an entire side of the blank 159 with a film of suitable adhesive (e.g., a so-called wet adhesive which sets in response to heating or a so-called hotmelt which is activated in response to heating). In many instances, it suffices if the paster 60 provides only the leader and/or the trailing end of each blank 159 with a film of adhesive material.

The paster 60 is followed by a blank introducing or draping device 61 having a frame 62 disposed between the paster and the draping station 7. The frame 62 supports three rollers or pulleys 63, 64 and 65 for an endless blank-deflecting or blank-contacting belt or band 66, and the frame 62 is pivotable about the axis of the pulley 63 by a pusher which is not specifically shown in FIG. 1. It suffices to say that pushing of the frame 62 entails a movement of the pulley 65 in the direction of arrow 67 in a region close to the underside of the roll 1 at the draping station 7. The force with which the frame 62 is pivoted about the axis of the pulley 63 is preferably small but it suffices to ensure proper overlapping of the leader and trailing end of the blank 159 after the blank was properly draped around the roll 1 between the heads 40 and 41 of the lifting device 8.

As mentioned above, the width of the selected web 59 exceeds the axial length of the roll 1 at the station 7 so that the two marginal portions of the blank 159 extend beyond the respective axial ends of the roll, i.e., beyond the inner discs 49 and 50 which abut against the respective end faces of the roll. The axial length of each of the distancing elements 42 and 43 is selected with a view to ensure that the blank 159 can be properly draped around the roll 1 at the station 7 in spite of the fact that the width of such blank exceeds the axial length of the roll.

The lifting device 8 can be furnished with one or more sets of spare distancing elements 42, 43 so that the length of the selected distancing elements will correspond to the desired extent to which the marginal portions of a blank 159 project beyond the end faces of a roll 1 which is suspended on the heads 40 and 41. As mentioned above, the inner discs 49, 50 are placed against the respective sides of the flanges 47 and 48 before the heads 40 and 41 move into actual engagement with the internal surface of the core 2.

The roll 1 (which is already draped into a blank 159 of paper or the like) is thereupon lowered by the device 8 to the position 1' which is indicated by phantom lines in the central portion of FIG. 1 (such lowering takes place by causing the means 34 to lower the sections 32, 33, the distancing elements 42, 43 and the heads 40, 41). The roll 1 is then in the range of a folding unit at a folding station 68. The folding unit comprises at least one folding wheel 69 at each axial end of the roll 1 and means for rotating and moving the wheels along the periphery of the respective disc 49 or 50 so as to fold the marginal portions of the draped blank 159 against the outer sides of the corresponding inner discs 49 and 50. Thus, the inner discs 49 and 50 are then confined in the spaces between the respective end faces of the roll 1 and the folded-over marginal portions of the blank 159. Parts of the unit at the folding station 68 can be located in a recess which is provided therefor in the floor F of the plant.

The reference character 70 denotes in FIG. 1 an RPM counter which generates signals denoting the rotational speed of the roll 1 at the draping station 7. Such signals are used to regulate the operation of the advancing mechanism 57, of the means for pivoting the frame 62 about the axis of the pulley 63 and of the means for operating the wheels 69 of the unit at the folding station 68.

The introducing or draping device 61 can be readily designed in such a way that its component parts exert a negligible pressure upon the outermost convolution of a roll 1 at the station 7. Such relatively small pressure should merely suffice to ensure that the blank 159 is draped around the roll 1 with a sufficient degree of tightness so that the wrapping paper closely follows the outline of the roll. This is in pronounced contrast with the operation of heretofore known apparatus wherein the roll rests on a conveyor or the like during draping of a blank therearound so that a substantial pressure is applied to the exterior of the blank and to the outermost convolution of the roll with the result that a highly sensitive material is likely to be damaged or defaced during draping of the roll into a blank of cardboard or the like. As mentioned above, conventional apparatus employ driven horizontal rollers on which the roll to be draped rests during the application of a blank therearound.

The folding station 68 is preferably located at a level below the draping or wrapping station 7. A relatively short downward movement of the roll 1 should suffice to move the roll from the station 7 into the range of folding instrumentalities 69 at the station 68. Such positioning of the station 68 relative to the station 7 is desirable and advantageous because it does not contribute to the length of the apparatus. Separation of the stations 7 and 68 is desirable and advantageous because the folding instrumentalities 69 at the station 68 can be moved to optimum positions while the instrumentalities at the station 7 drape the blank 159 around the roll 1. In other words, the folding unit at the station 68 is ready to begin with the folding operation immediately after the roll 1 moves to the position 1' of FIG. 1.

The device 8 thereupon lifts the roll 1 above the phantom-line position 1' and transports the thus lifted roll in a direction to the left, as viewed in FIG. 1, with attendant pivoting of the frame 62 about the axis of the pulley 63 in a clockwise direction, i.e., the roll 1 temporarily displaces the frame 62 while advancing toward a position above a cushion 71 forming part of an element 72 of an intermediate transporting device or conveyor 73. The cushion 71 resembles a flute wherein the adjacent portion of the draped blank 159 comes to rest before the intermediate conveyor 73 is set in motion to advance the roll 1 in a direction to the left, i.e., away from the draping station 7 of FIG. 1. It goes without saying that transport of the roll 1 with the cushion 71 along the path which is defined by the intermediate conveyor 73 is preceded by disengagement of the heads 40, 41 from the respective end portions of the core 2. The transporting element 72 of the conveyor 73 is movable by a cable or cord 74 which is attached to a mobile component of a fluid-operated motor 75, such as a cylinder-and-piston unit installed in a recess of the floor F at a level below the conveyor 73. The cable or cord 74 advances the element 72 with the roll 1 thereon into the range of a pressing means 76 which has two plate-like pressure applying members 77 (only one shown in FIG. 1) adapted to move toward the outer sides of the folded-over marginal portions of the draped blank 159 on the roll 1 and to press two outer discs (not shown) against such folded-over marginal portions to thereby complete the making of a cylindrical envelope around the roll 1. The outer discs are placed against the exposed surfaces of the pressure applying members 77 before such members advance toward the respective end faces of the roll 1 at the station for the pressing means 76.

The conveyor 73 defines for successive rolls 1 an elongated path which is parallel to the path defined by the rails 9. The pressing means 76 is adjacent to that portion of the path defined by the conveyor 73 which is remote from the draping station 7, i.e., which is remote from the path of movement of the lifting device 8.

If desired, the feeding unit 3 can constitute or replace the intermediate conveyor 73 of FIG. 1. However, the provision of a discrete intermediate conveyor is desirable in many instances. Thus, there is no need to change the orientation of the rolls 1 between the station 7 or 68 and the station for the pressing means 76 because the intermediate conveyor 73 can be readily designed with a view to transport the rolls 1 sideways, i.e., at right angles to the axes of the respective cores 2. Moreover, there is no need to synchronize the introduction of rolls 1 into the monitoring station 200 with the transfer of draped rolls 1 from the station 7 or 68 to the station for pressing means 76. Still further, the lifting device 8 can return toward the monitoring station 200 to accept and lift a fresh roll 1 while a draped roll advances from the station 7 toward the station for the pressing means 76; this contributes to higher output of the improved apparatus.

The wrapped roll 1 is then engaged and manipulated by a tilting or orientation changing device 78 the details of which are shown in FIGS. 5 to 7 and which is located to the left of the pressing means 76, as viewed in FIG. 1. The device 78 comprises a main support or bridge 79 with two upright guide columns 80 and 81 and rollers or wheels 82 which are arranged to travel along the I-beams or rails 9. The means for driving the wheels 82 so as to move the bridge 79 in the directions indicated by a double-headed arrow 88 shown in FIG. 1 comprises a reversible electric motor 83 which transmits torque to the input element of a transmission 84. The latter can rotate a shaft 85 carrying gears 86 and 87 in mesh with the respective wheels 82 (see FIG. 5).

The columns 80 and 81 guide a vertically reciprocable support 89 in the form of a platen which is movable up and down (see the double-headed arrow 103 in FIG. 5) by one or more fluid-operated motors (e.g., cylinder-and-piston units) 90 and one or more flexible elements 91 in the form of chains, cables, cords, ropes or the like. The platen 89 supports two mating gears 92 and 93 the former of which can be rotated by an electric motor 94 (see particularly FIG. 6) to thereby change the angular position of the gear 93. The gear 93 supports a holder 95 for the orientation changing unit of the device 78 and serves to turn the holder 95 clockwise or counterclockwise (see the arrow 104 in FIG. 5). The holder 95 supports two arms 96 and 97 which are movable toward and away from each other (note the double-headed arrows 105 in FIG. 7), namely, into and from engagement with the exposed sides of outer discs on a fully wrapped roll 1. The means for moving the arms 96 and 97 toward and away from each other comprises fluid-operated motors 98 and 99 which are mounted on the holder 95 and are actuatable in response to appropriate signals or from a control panel, not shown. The outer side of the arm 96 is biconcave (see FIG. 5) so that it can fit into the gap between the adjacent rollers 100, 101 of a removing or evacuating conveyor 102. FIG. 5 shows the arm 96 in two different positions; when in the position 96″, the arm 96 is located in the gap between the rollers 100, 101 so that it does not interfere with removal of a finished roll 1 by the conveyor 102.

The operation of the orientation changing device 78 is as follows:

When the treatment of the roll 1 at the station for the pressing means 76 is completed, the members 77 are moved away from the respective ends of the wrapped roll 1 to provide room for the arms 96 and 97. The motor 83 is then set in motion to drive the wheels 82 which advance the bridge 79 along the rails 9 toward the station for the pressing means 76 so that the arms 96 and 97 (which are held apart so that the distance therebetween exceeds the axial length of the finished roll 1) can move adjacent to the respective end faces of the roll 1 which rests on the cushion 71 of the element 72 forming part of the intermediate conveyor 73. In other words, the arms 96 and 97 move between the respective end faces of the roll 1 and the pressure-applying members 77. The motors 98 and 99 are thereupon actuated to move the arms 96, 97 against the respective outer discs, i.e., the arms 96, 97 engage the finished product with a force which suffices to ensure that the product is lifted when the motor means 90 is thereupon actuated to lift the platen 89 in a direction toward the bridge 79. The motor 83 is then started in reverse to advance the wheels 82 along the rails 9 so that the bridge 89 moves to a position above the conveyor 102 where the platen 89 descends so that the exposed side of one of the outer discs comes to rest on the rollers of the removing conveyor 102 in the following way:

Prior to lowering the platen 89 at the station above the removing conveyor 102, the motor 94 is started to rotate the gears 92 and 93 through 90° so that the arm 96 moves to a level below the arm 97. The platen 89 is then lowered so that the exposed side of the lower outer disc comes to rest on one or more rollers of the removing conveyor 102. The motors 98 and 99 are then actuated to move the arms 96 and 97 away from each other whereby the arm 96 assumes the position 96″ of FIG. 5 and the orientation changing device 78 is thus disengaged from the finished roll 1. The rollers of the conveyor 102 are thereupon set in motion to advance the finished roll 1 to storage, onto a conveyance or to another destination.

The orientation changing device 78 is an optional but highly desirable and advantageous component of the improved apparatus. This device ensures that a fully wrapped roll 1 need not rest on its side but rather on one of its end faces which are much less sensitive than the peripheral surface. Moreover, the roll 1 which rests on the removing conveyor 102 is separated from the rollers 100, 101 and other rollers of the removing conveyor by an inner disc, by an outer disc and by a layer of folded wrapping material between the two discs. This further reduces the likelihood of damage to the roll 1 during transfer onto and during transport with the removing conveyor 102. The provision of arms 96 and 97 (which engage the outer sides of the respective outer discs) also contributes to gentle treatment of the roll by the orientation changing device 78; as mentioned above, these arms need not contact the periphery of the roll 1 but merely bear against the outer discs which, in turn, apply pressure against the respective end faces of the roll 1 by way of the inner discs and layers of folded wrapping material between the inner and outer discs.

Another advantage of the orientation changing device 78 is that it can perform a pure or simple transporting function, namely, of moving finished rolls from the intermediate conveyor 73 onto the removing conveyor 102. A removing conveyor which employs driven rollers (such as 100 and 101) is preferred at this time; however, it is equally within the purview of the invention to employ a removing conveyor which utilizes plates, one or more belts, chains or other suitable roll-advancing means. Moreover, the provision of rollers (such as 100 and 101) renders it possible to move the arm 96 of the orientation changing device 78 to a level below the apices of the rollers 100 and 101 during transfer of a roll 1 onto the conveyor 102 so that the roll 1 can be readily engaged and removed by the rollers of the removing conveyor while the arm 96 dwells in the position 96″ of FIG. 5. All that is necessary is to provide one side of the arm 96 with two recesses **96*a* bounded by concave surfaces whose radii of curvature resemble those of the adjacent rollers 100 and 101. It has been found that the device 78 can deposit rolls 1 gently so that the rolls are neither damaged nor defaced during transfer onto the removing conveyor 102**.

The motor 83 can move the holder 95 between a first position where the holder (and more particularly the arms 96, 97 on the holder) can accept successive rolls 1 from the intermedite conveyor 73, and a second position where the holder 95 turns the rolls 1 through 90° so that the orientation of the axis of each roll 1 is changed from horizontal to vertical. The rails 9 define for the holder 95 a path which is parallel to and aligned with the path of movement of the lifting device 8 between the stations 200 and 7 and along which the holder 95 moves between its first and second positions. The path of movement of the element 72 of the intermediate conveyor 73 between its end positions is parallel to the path of movement of the holder 95 between its first and second positions.

An important advantage of the improved apparatus is that the lifting device 8 can transport rolls 1 all the way from the feeding unit 3 to the draping station 7 and folding station 68 prior to delivery of rolls 1 onto the intermediate conveyor 73. Thus, there is no need for the provision of means for rotating the rolls 1 through the medium of elements which engage the end faces and/or the periphery of a roll at the station 7 and/or 68; this ensures that the rolls are treated gently and are not defaced, deformed and/or otherwise damaged even if they consist of a highly sensitive flexible material and even if such material is convoluted in loose form which should remain unchanged during confinement of rolls in envelopes including blanks 159 and pairs of outer discs. In other words, the lifting device 8 ensures that the rolls 1 need not be rolled at any stage of treatment at the monitoring station 200, at the station 7 and/or 68, and/or on the intermediate conveyor 73. Analogously, the orientation changing device 78 ensures that the rolls 1 need not be rolled during turning through 90 degrees preparatory to deposition on the removing conveyor 102. The material of the cores 2 is or can be sufficiently sturdy to ensure that the rolls 1 can be lifted, lowered, moved sideways and/or rotated without necessitating any engagement of their peripheral and/or end faces with rollers and/or other supporting, torque transmitting and/or analogous components. It will be seen that the improved apparatus is suitable for treatment of rolls consisting of highly sensitive material; however, the apparatus is equally useful for the treatment of rolls whose material can stand pronounced deforming and/or other stresses, i.e., for the treatment of rolls which, heretofore, were successfully manipulated in conventional apparatus such as the aforediscussed "Typ 6.6" of the assignee of the present application.

The orientation changing device 78 and the removing conveyor 102 can be omitted if the intermediate conveyor 73 constitutes or forms part of a removing conveyor, i.e., if the finished rolls 1 need not be turned through 90° prior to deposition on the removing conveyor.

The manner in which the elements 4 and 72 are cushioned to properly support the rolls 1 without any damage to their outermost convolutions depends on a plurality of factors, such as the weight of the rolls, the nature of sheet material which is convoluted on the cores 2, the length of intervals during which a roll 1 is to rest on the element 4 and/or cushion 71 and/or a combination of these. Furthermore, the areas of cushions on the elements 4 and/or the area of cushion 71 is preferably large so as to reduce the pressure per unit area of the external surface of a roll 1 to a minimum.

Figure 8:
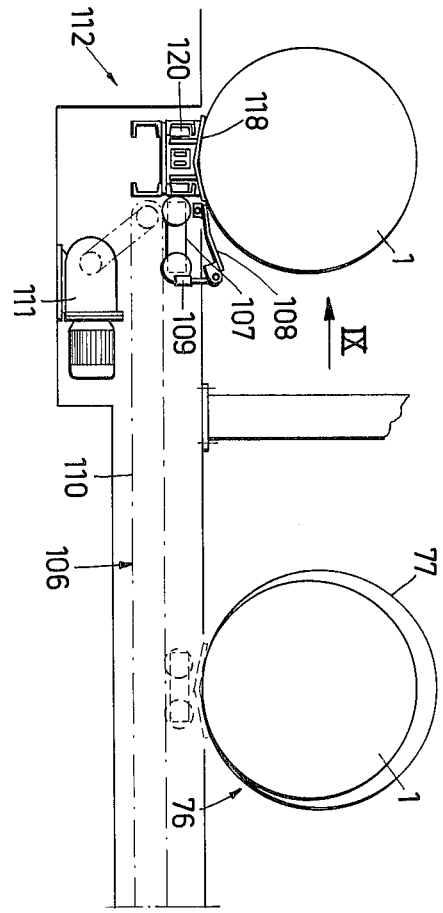
FIG. 8 is a fragmentary elevational view of a portion of a modified apparatus.
Figure 9:
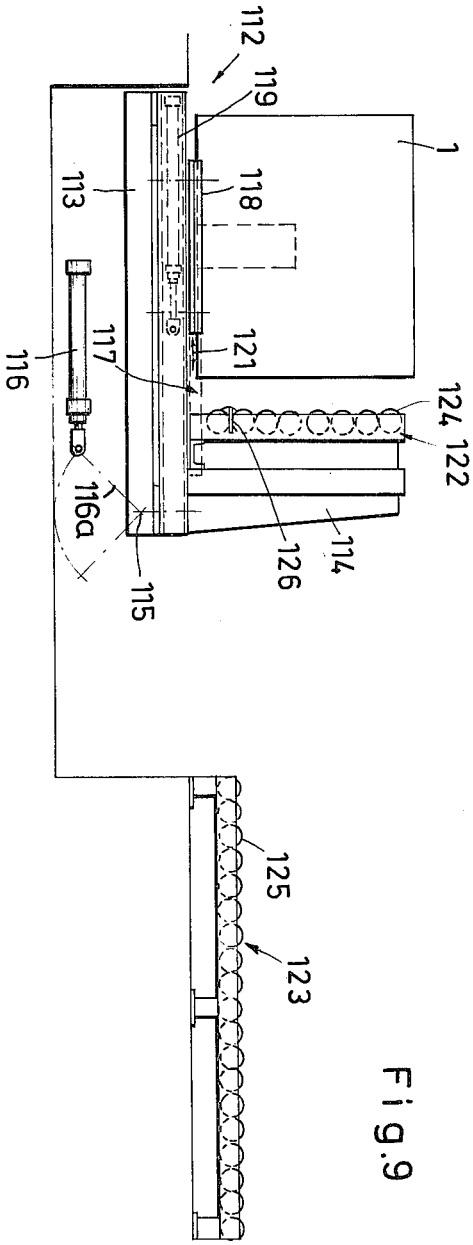
FIG. 9 is a view as seen in the direction of arrow IX in FIG. 8.

FIGS. 8 and 9 illustrate an intermediate conveyor system 106 which replaces the intermediate conveyor 73 of FIG. 1 and a portion of a modified orientation changing device. Thus, the intermediate conveyor system 106 can transport rolls 1 all the way from the draping station 7 (not shown in FIG. 8 and 9) to a removing conveyor 123 which performs the function of the removing conveyor 102 shown in FIG. 1.

The intermediate conveyor system 106 comprises a transporting element 107 in the form of a conveyance having a wheel-mounted frame and being associated with an ejecting device 109 adapted to tilt its roll-supporting portion 108 so that a roll 1 which was supported by the preferably cushioned upper side of the portion 108 rolls off the conveyance 107 and onto a preferably cushioned receiving member 118 forming part of an orientation changing device for finished rolls 1. The ejecting device 109 can constitute a fluid-operated (preferably pneumatic) cylinder and piston unit which can lift the adjacent edge of the portion 108 so that the latter turns about the axis of a hinge (not specifically shown) serving to connect a second edge of the portion 108 to the frame of the conveyance 107. The latter is movable back and forth by an endless flexible element 110 (e.g., a cable or rope) and a motor 111 whose output element drives one sprocket wheel or pulley for the element 110. The arrangement is such that the conveyance 107 comes to a halt at three different stations, namely, at the draping station 7, at the pressure-applying station (members 77) and at the orientation changing station 112 where the finished roll 1 is turned through 90° and is thereupon deposited onto the removing conveyor 123. The orientation changing station 112 is located at the left-hand end of the path which is defined by the intermediate conveyor system 106 (as viewed in FIG. 8).

The orientation changing device at the station 112 comprises two portions or legs 113 and 114 which make an angle of 90° and are turnable about a common axis 115 which extends at right angles to the path of movement of the conveyance 107. The means for pivoting the legs 113 and 114 about the axis 115 (clockwise as well as counterclockwise) comprises a motor 116 (e.g., a hydraulically or pneumatically operated cylinder-and-piston unit whose piston rod is articulately connected with a lever 116*a* secured to the legs 113, 114 and pivotable about the axis 115).

The leg 113 is provided with a first transporting means 117 including the aforementioned cushioned member 118 adapted to receive successive finished rolls 1 from the pivotable portion 108 of the conveyance 107 and to move at right angles to the plane of FIG. 8, i.e., at right angles to the direction of movement of the conveyance 107. The frame of the member 118 is provided with wheels 120 which roll (see the arrow 121) along rails provided on the leg 113 and can move the member 118 lengthwise of such rails (at right angles to the plane of FIG. 8) in response to actuation of a motor 119 (e.g., a pneumatically or hydraulically operated cylinder-and-piston unit). When it assumes the end position of FIG. 8, the member 118 is immediately adjacent to the corresponding end turn of the intermediate conveyor system 106 so that it can receive a roll 1 from the portion 108 in response to actuation of the ejecting device 109. The roll 1 on the member 118 is then transported along the leg 113 toward the leg 114, namely, into the range of an auxiliary conveyor 122 on the leg 114. The member 118 is then arrested by a limit switch 126 before the motor 116 is started to pivot the legs 113, 114 about the axis 115 through 90° so that the orientation of the roll 1 is changed by 90° and the roll comes to rest on the rollers 124 of the auxiliary conveyor 122. The rollers 124 are then aligned with similar rollers 125 of the conveyor 123 so that the latter can remove the finished roll 1 from the apparatus by moving it in a direction to the right, as viewed in FIG. 9. The roll 1 is held in such orientation that its axis is vertical, i.e., the exposed side of one of the outer discs rests on the adjacent rollers 125 of the conveyor 123. It will be noted that the auxiliary conveyor 122 on the leg 114 constitutes an extension of the removing conveyor 123 after the legs 113, 114 are pivoted through 90° and in a clockwise direction, as viewed in FIG. 9.

The apparatus which embodies the features shown in FIGS. 8 and 9 is somewhat simpler than the apparatus of FIG. 1, especially as concerns the design of the orientation changing device. All that is necessary is to provide each of the two legs 113, 114 with a relatively short conveyor and to provide means for simultaneously tilting or pivoting the two legs about a common axis.

The improved apparatus is susceptible of many further modifications without departing from the spirit of the invention. For example, the illustrated fluid-operated moving means can be replaced by electrically operated moving means or vice versa. Furthermore, the moving means may employ rack and pinion drives, cables and pulleys, rotary electromagnets, nuts and feed screws and/or a host of other well known arrangements for transmitting reciprocatory, rotary and/or other motion.

If the orientation changing device is not required or desired, the intermediate conveyor can constitute the removing conveyor of the apparatus. It is further possible to place the draping station 7 and/or the folding station 68 immediately above the feeding unit 3 and to employ the feeding unit in lieu of the intermediate conveyor, e.g., to transport rolls 1 to the pressure-applying station including the members 77. Still further, the illustrated means for draping blanks 159 around rolls 1 at the station 7 or an analogous station can employ means for directing jets of air against selected portions of a blank, rollers which gently drape a blank around a roll consisting of highly sensitive material, sheet metal guides and/or a combination of such devices. The same holds true for the means which fold the marginal portions of the blanks 159 against the adjacent end faces of the roll 1 at the station 68.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an apparatus for providing a series of substantially cylindrical rolls consisting of convoluted paper or the like and having coaxial recesses in the end faces thereof with inner discs which are placed adjacent to the end faces of the rolls, with blanks whose width exceeds the axial length of the rolls so that the marginal portions of the blanks extend beyond and can be folded over the respective inner discs, and with outer discs which are applied over the folded-over marginal portions of the blanks, the combination of a feeding unit having means for supplying successive rolls of said series to a predetermined location where the axes of the rolls are substantially horizontal; conveyor means spaced apart from said location and including a roll-removing conveyor; a lifting device for transferring successive rolls along a predetermined path from said location toward said conveyor means, comprising a pair of coaxial clamping means, means for moving said clamping means along said path, means for moving said clamping means toward and away from each other so that the clamping means can be introduced into the recesses of a roll at said location prior to transport of said clamping means toward said conveyor means and withdrawn from the recesses upon deposition of the roll on said conveyor means, and means for rotating a roll between said clamping means about the axis of such roll through the medium of at least one of said clamping means; and means for changing the orientation of successive rolls prior to transfer of such rolls onto said removing conveyor.

2. The combination of claim 1, wherein said means for moving said clamping means toward and away from each other comprises a pair of spaced-apart sections, one for each of said clamping means, a distancing element interposed between each of said sections and the respective clamping means, and motor means for moving said sections toward and away from each other.

3. The combination of claim 1, further comprising means for draping blanks about successive rolls in a predetermined portion of said path and means for thereupon folding the marginal portions of the thus draped blanks.

4. The combination of claim 1, wherein each of the rolls has a coaxial hollow core defining a hole which includes said recesses, said clamping means including heads with portions movable outwardly into engagement with the surface bounding the hole of a core.

5. The combination of claim 1, wherein said lifting device further comprises means for moving said clamping means up and down with reference to said path so that said clamping means can lift successive rolls off said feeding unit and deposit successive rolls on said conveyor means.

6. The combination of claim 1, wherein said supplying means includes cushions for the rolls on said feeding unit.

7. The combination of claim 1, wherein said conveyor means comprises cushion means for deposition of rolls thereon.

8. The combination of claim 1, wherein said supplying means of said feeding unit is movable in parallelism with the common axis of said clamping means and further comprising means for arresting said supplying means in such positions that the rolls arriving at said predetermined location are halved by an imaginary symmetry plane which is normal to the common axis of said clamping means.

9. The combination of claim 8, wherein said arresting means includes sensor means arranged to monitor the dimensions of rolls arriving at said predetermined location.

10. The combination of claim 1, further comprising signal generating sensor means for monitoring the dimensions of rolls arriving at said predetermined location and means for moving said clamping means up and down relative to said path in response to signals from said sensor means so as to place said clamping means into register with the recesses of a roll at said predetermined location.

11. The combination of claim 10, wherein said sensor means includes means for monitoring the diameters of rolls at said predetermined location.

12. The combination of claim 1, further comprising signal generating sensor means provided on said lifting device to monitor the levels of recesses in the roll at said predetermined location and means for moving said clamping means up and down with reference to said path in response to signals from said sensor means so as to place said clamping means into register with the recesses of the roll at said predetermined location.

13. The combination of claim 1, wherein said lifting device further comprises an inner disc carrier for each of said clamping means, said carriers being coaxial with said clamping means.

14. The combination of claim 13, wherein the inner discs have central openings in register with the recesses in the respective end faces of the rolls.

15. The combination of claim 1, wherein said means for moving said clamping means toward and away from each other comprises means for shifting said clamping means through identical distances but in opposite directions.

16. The combination of claim 15, wherein said shifting means comprises a pair of spaced-apart sections, one for each of said clamping means, each of said clamping means being rotatable relative to but being held against axial movement with reference to the corresponding section, said shifting means further comprising motor means for moving said sections toward and away from each other.

17. The combination of claim 15, further comprising signal generating sensor means provided at said predetermined location to monitor the dimensions of rolls supplied by said feeding unit, said shifting means being responsive to signals from said sensor means to move said clamping means apart to positions such that the distance between said clamping means exceeds the axial length of a roll when a fresh roll is delivered to said location.

18. The combination of claim 15, further comprising sensor means provided on said lifting device to terminate the movement of said clamping means toward each other when such clamping means enter the recesses at the respective ends of a roll at said predetermined location.

19. The combination of claim 18, wherein said sensor means comprises switch means.

20. The combination of claim 1, wherein said path is substantially horizontal and extends substantially at right angles to the common axis of said clamping means.

21. The combination of claim 20, further comprising means for draping blanks about successive rolls in a first portion of said path and means for folding the marginal portions of the thus draped blanks in a discrete second portion of said path.

22. The combination of claim 1, further comprising means for draping blanks about successive rolls in a predetermined portion of said path, said draping means comprising at least one blank-contacting element and means for moving such element gently into contact with the blank on a roll in said predetermined portion of said path.

23. The combination of claim 1, further comprising means for draping blanks about successive rolls in a first portion of said path and means for folding the marginal portions of the thus draped blanks in a discrete second portion of said path, said second portion being located at a level below said first portion of said path.

24. The combination of claim 1, wherein said conveyor comprises a roll-supporting element movable at right angles to the common axis of said clamping means.

25. The combination of claim 24, wherein said conveyor means defines a second path along which successive rolls are movable by said element and further comprising means for pressing outer discs against the folded-over marginal portions of blanks on successive rolls, said pressing means being adjacent to a predetermined portion of said second path.

26. The apparatus of claim 1, wherein said orientation changing means comprises two mutually inclined legs and means for pivoting said legs about a common axis which is normal to the axis of a roll supplied by said lifting device, one of said legs being arranged to receive successive rolls while the axes of such rolls are substantially horizontal and the other of said legs being arranged to receive successive rolls from said one leg upon pivoting of said legs about said common axis to such an extent that the axes of rolls on said second leg are substantially vertical.

27. The combination of claim 1, wherein said orientation changing means comprises a holder, means for moving said holder along a second path between a first position where said holder receives successive rolls in such orientation that the axes of the rolls are substantially horizontal and a second position adjacent to said removing conveyor, and means for turning said holder about an axis which is normal to the axis of a roll carried by said holder so that the axis of each roll reaching said removing conveyor is at least substantially vertical.

28. The combination of claim 27, wherein said orientation changing means further comprises a pair of arms provided on said holder and means for moving said arms toward and away from each other so that the arms can engage the outer discs on a roll in the first position of said holder and can move away from the roll when said holder reaches said second position.

29. The combination of claim 28, wherein said conveyor means further includes an intermediate conveyor which receives rolls from said lifting device and is arranged to deliver such rolls to said holder in the first position of said holder.

30. The combination of claim 29, wherein said intermediate conveyor defines a third path which is parallel with said second path.

31. The combination of claim 28, wherein said removing conveyor comprises rollers disposed at a level below the holder when the latter assumes said second position, said rollers defining a gap for one of said arms when said holder reaches said second position and the arms are moved away from each other to thus deposit a roll on the rollers of said removing conveyor.

32. The apparatus of claim 31, wherein said one arm has recesses bounded by concave surfaces and arranged to receive portions of rollers of said removing conveyor.

33. The apparatus of claim 26, wherein the transporting means of said one leg is arranged to move rolls away from said intermediate conveyor and the transporting means of said other leg forms part of said removing conveyor.

34. The apparatus of claim 26, wherein said legs make an angle of 90° and said pivoting means comprises means for turning said legs back and forth through angles of 90° .

35. The apparatus of claim 34, wherein said conveyor means further includes an intermediate conveyor arranged to deliver successive rolls from said lifting device to said one leg of said orientation changing means.

36. The apparatus of claim 35, wherein each of said legs comprises means for transporting rolls therealong.

* * * * *